US008598495B2

(12) United States Patent
Davidson

(10) Patent No.: US 8,598,495 B2
(45) Date of Patent: Dec. 3, 2013

(54) CONTAINER HEATING DEVICE

(76) Inventor: James W. Davidson, Hartville, OH (US)

( * ) Notice: Subject to any disclaimer, the term of this patent is extended or adjusted under 35 U.S.C. 154(b) by 195 days.

(21) Appl. No.: 12/931,025

(22) Filed: Jan. 21, 2011

(65) Prior Publication Data

US 2011/0180528 A1 Jul. 28, 2011

Related U.S. Application Data

(60) Provisional application No. 61/336,578, filed on Jan. 22, 2010.

(51) Int. Cl.
*H05B 3/68* (2006.01)
*H05B 3/00* (2006.01)

(52) U.S. Cl.
USPC ..... 219/465.1; 219/201

(58) Field of Classification Search
USPC ..... 219/201, 202, 443.1, 452.11–453.11, 219/536, 537
See application file for complete search history.

(56) References Cited

U.S. PATENT DOCUMENTS 2,070,095 A * 2/1937 Shepard, Jr. et al. ..... 280/47.16
2,725,459 A * 11/1955 Farnsworth et al. ..... 219/433
2,919,339 A * 12/1959 Hilliker ..... 219/400
3,478,193 A * 11/1969 Molitor ..... 219/386
3,797,375 A * 3/1974 Cerola ..... 99/340
3,870,862 A * 3/1975 Doner ..... 219/452.12
5,002,304 A * 3/1991 Carrigan, Jr. ..... 280/655
5,159,177 A * 10/1992 Kinberger ..... 219/386
5,961,866 A * 10/1999 Hansen ..... 219/434
5,981,914 A * 11/1999 Schultheis ..... 219/452.11
7,513,511 B2 * 4/2009 Chaseateau ..... 280/47.27
7,740,251 B2 * 6/2010 Simmons ..... 280/47.27

OTHER PUBLICATIONS

HOLROYD Type HBD Base Drum Heaters downloaded from the internet Nov. 17, 2009.
ISOPAD Drum and Base Heaters available from Tyco Thermal Controls of Redwood City, CA Aug. 2007.
Thermosafe Drum and IBC heaters internet information printed Nov. 17, 2009.

* cited by examiner

*Primary Examiner* — Sang Y Paik
(74) *Attorney, Agent, or Firm* — Hudak, Shunk & Farine Co. LPA

(57) ABSTRACT

A device for heating containers, in particular drums, for example containing liquid materials that undergo temperature-induced changes in viscosity. The device has a heat conducting base upon which a drum is adapted to be placed. In one embodiment, the device is provided with a plurality of interchangeable bases designed to be used with different liquids that are effective to heat a liquid to a desired temperature.

18 Claims, 4 Drawing Sheets

CONTAINER HEATING DEVICE

CROSS REFERENCE

This Application claims the benefit of priority under 35 U.S.C. §119 of U.S. Provisional Application Ser. No. 61/336,578, filed on Jan. 22, 2010, herein fully incorporated by reference.

FIELD OF THE INVENTION

The present invention relates to a device for heating containers, in particular drums, for example containing liquid materials that undergo temperature-induced changes in viscosity. The device comprises a heat conducting base upon which the container is adapted to be placed. In one embodiment, the device is provided with a plurality of interchangeable bases or heating elements or a combination thereof designed to be used with different liquids that are effective to heat a liquid and to maintain a desired temperature.

BACKGROUND OF THE INVENTION

Many industries require liquid materials of a particular viscosity and/or temperature range so that they can be processed on certain handling equipment, for example spray equipment. Moreover, many such liquids are stored under ambient conditions that can vary and are generally not optimum temperature-wise. If the ambient temperature is low enough, the liquid may become a solid.

Various attempts to provide devices for heating drums, by way of non-limiting examples, include side drum heaters having electric straps, jackets, bands or belts attachable around the circumference of a drum, forced air heaters, electric space heaters, thermostat controlled base heaters comprising a wire element, glass impregnated, silicone rubber heater mat such as available from Holroyd Components Ltd. of the UK, drum ovens, and induction base heaters, for example as available from Thermosafe Ltd. of England. Base drum heaters are also available from Tyco Thermal Controls of Redwood City, Calif.

SUMMARY OF THE INVENTION

In view of the above it would be desirable to provide a device for heating containers, preferably drums having liquid chemicals stored therein, to a predetermined temperature or within a range defined by the manufacturer, without overheating the liquid chemicals.

An object of the present invention is to provide a heating device that can raise the temperature of a material to a desired temperature in a desired period of time, such as a period of hours or overnight so that the material can be processed.

A further object of the present invention is to provide a heating device that includes two or more heating elements that can be activated to provide a plurality of heating settings.

Yet another object of the present invention is to provide a heating device that does not require a thermostat or rheostat to operate.

A further object of the present invention is to provide a heating device having a frame adapted to securely hold a drum or container during transportation or even at a stationary location at a job site.

Still another object of the present invention is to provide a heating device having a frame adapted to be mounted to a floor of a vehicle, such as a truck or trailer as a permanent or temporary fixture. In some embodiments, the frame is provided with mounting brackets that are adapted to be fastened to or through a floor of the vehicle.

A further object of the present invention is to provide a heating device with a frame having a plurality of wheels thereby providing mobility thereto.

A further object of the present invention is to provide a heating device with a heat conductive base to provide for desired heat transfer through the base to the container.

Yet another object of the present invention is to provide a conductive base comprising a heat conducting material, in one embodiment a metal such as aluminum.

A further object of the present invention is to provide a heating device with heating elements with relatively low wattage, but that are highly efficient.

Still another object is to provide a plurality of low wattage heating devices that can be connected to a single source of electric power, for example 120 volt AC at 20 amp service. A further object is to provide a base comprising a plurality of heating elements operatively connected to a conductive base, wherein the heating elements are provided with an insulating cover that directs the heat from the heating element to the heat conductive plate.

A further object of the present invention is to provide a heating device that provides both convective heat transfer and conductive heat transfer. In one embodiment an air space is provided between a portion of the container and the base which aids in preventing a localized hot spot from forming between the base and container.

An additional object of the present invention is to provide a heating device with a heat conductive base plate comprising a heat conducting raised edge.

Still another object of the present invention is to provide a heating device having a plurality of interchangeable bases, including a first base having at least one heating element and a second base comprising at least two elements, wherein each base is configured to provide a desired heat range and therefore a plurality of different liquid materials can be heated to different temperatures by utilizing one of the interchangeable bases.

Another aspect of the present invention is a heating device for a container comprising a frame comprising a pair of lower members connected to a pair of crossmembers, a base connected to the frame; and a heating system comprising a heating element connected to a bottom surface of the base, the base comprising a heat conducting material, when the heating element is adapted to transfer heat generated into the base, wherein the heating system is free of a rheostat and a thermostat.

Accordingly, another aspect of the invention is a heating device comprising a frame with a wiring system having a plug connected to the frame and also operatively connected to a control device, a first base having one or more heating elements and a first heating range, the one or more heating elements connected to a first connector; and a second base having one or more heating elements and a second heating range different than the first heating range, the one or more heating elements connected to a second connector, wherein the first base and the second base are interchangeable on the base and the first connector and the second connector are mateable with the plug of the wiring system.

BRIEF DESCRIPTION OF THE DRAWINGS

The invention will be better understood and other features and advantages will become apparent by reading the Detailed Description of the Invention, taken together with the drawings, wherein.

DETAILED DESCRIPTION OF THE INVENTION

Figure 2:
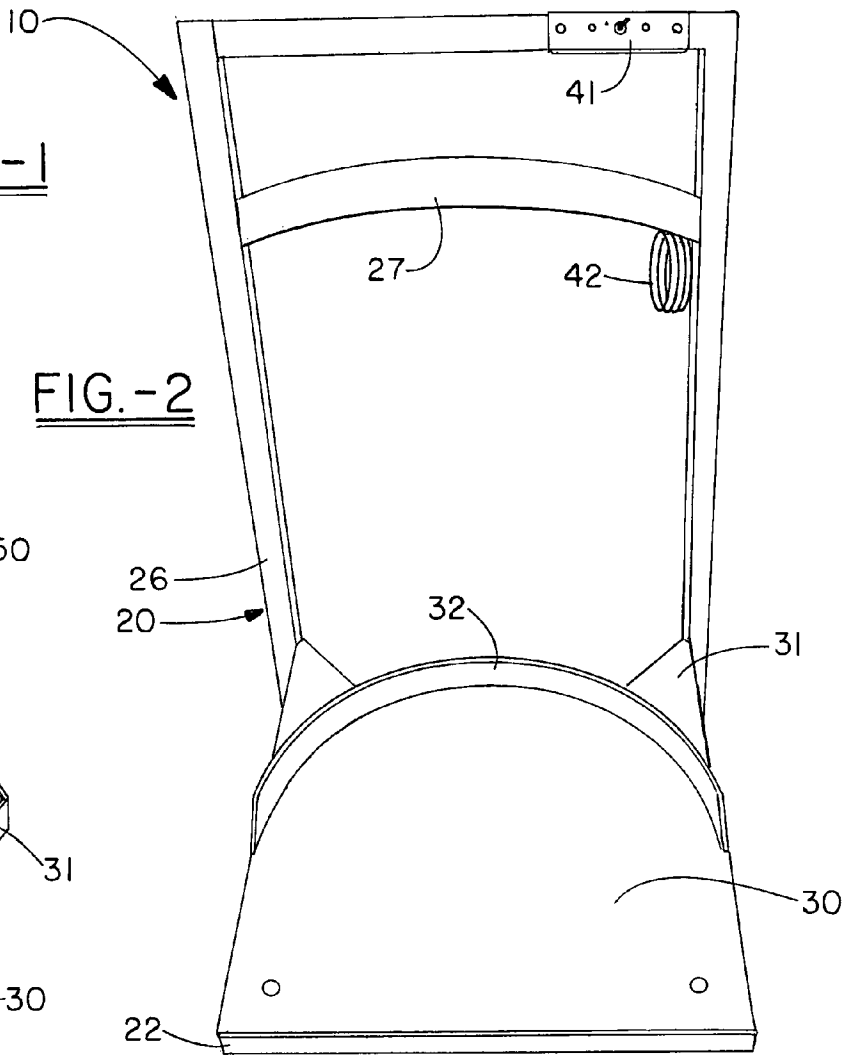
FIG. 2 is a front elevational view of the embodiment of the container heating device illustrated in FIG. 1, particularly showing a heat conducting base operatively connected to a frame and a control device for operating the heating elements contained within the base.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 1:
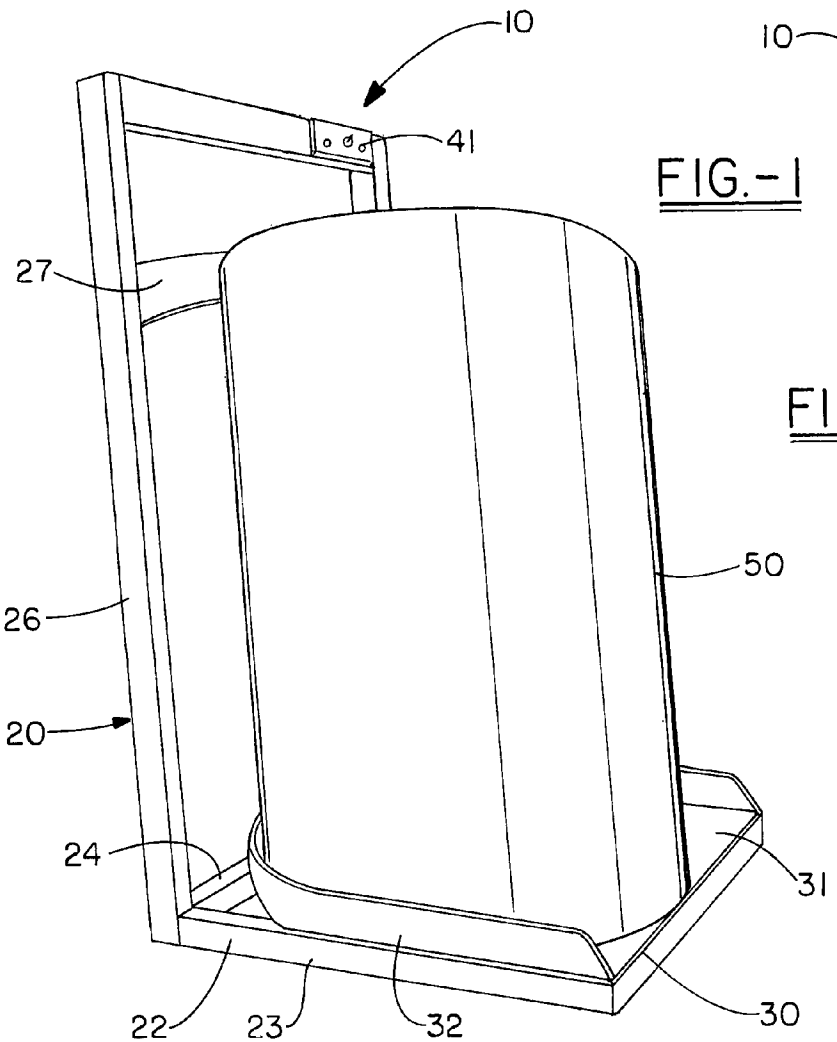
FIG. 1 is a side perspective view of one embodiment of a container heating device of the present invention illustrating a drum located on the base of a device.
Figure 3:
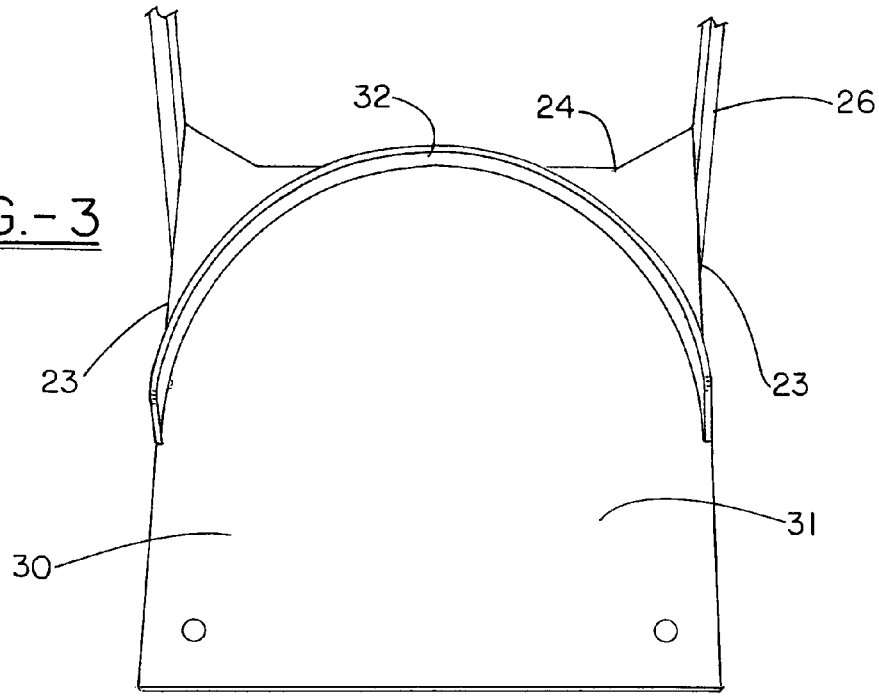
FIG. 3 is a top perspective view of a lower portion of the heating device, particularly illustrating one embodiment of a heat conducting base operatively connected to the frame and having a raised edge to ensure proper positioning of a cylindrical container on the base.

The present invention relates to a heating or warming device for containers, in particular drums, containing a liquid material or a solid material desired to be in liquid form. Referring now to the drawings wherein like reference numbers refer to like or similar parts or structures throughout the several Figures, FIG. 1 illustrates one embodiment of a heating device 10 including a frame 20 that supports a heat transferring base 30. The base 30 is shown in direct contact with a container 50, illustrated as a drum, with the bottom 52 thereof directly contacting an upper surface of the base 30.

The frame 20 has a lower member 22 adapted to be placed on a surface, such as the ground, a floor, a bed of a vehicle, or the like. The lower member 22 also serves as a support for base 30. Lower member 22 in one embodiment includes a box-type shell or casing that protects some of the components of the heating system 40, in particular the heating elements operatively connected to the base 30. The casing of the lower member 22 preferably includes at least two side members 23 connected by crossmembers 24. Additionally, one or more supports 25 can be utilized to provide additional strength to the lower member 22. One or more of the side member 23, crossmember 24 and support 25 can be hollow or include one or more hollow segments to allow for routing of cabling or wiring of the heating system therethrough.

In some embodiments, the base 30 includes a support pillar 26 connected to the lower member 22 and/or crossmember 24. The support pillar 26 is optional, but preferred. The pillar 26 in some embodiments has a cradle 27 adapted to support or abut a portion of a container. As illustrated in FIG. 2, in one embodiment the cradle 27 has an archial shape and thus a contour that substantially matches the contour of a standard 55-gallon drum, see FIG. 1 for example. Additionally, straps or rings can be used to secure the container to the pillar 26, which is advantageous during transportation when the heating device is located on a vehicle. The pillar 26 can comprise one or more sections. In FIG. 2 the pillar is illustrated having a pair of upright sections connected by the cradle 27 and a crossbar. The upright sections are connected to the lower member 22 at the intersection of the side member 23 and rear crossmember 24 in the embodiment illustrated.

In FIG. 2 a control device 41 of the heating system is illustrated attached to the pillar 26, thereby providing a convenient location for manipulation by the user.

In the embodiment illustrated in the figures, the control device 41 is a three-position switch, in particular a toggle switch, including indicator lights. The control device therefore comprises a plurality of heating positions as well as an off-position. Indicator lights are utilized and are therefore lit when one of heating positions is selected. In the embodiment illustrated, the control device 41 has a central off position, a low heat position to the left and a high heat position to the right, when the control device is viewed from the front. Other suitable control devices include, but are not limited to rocker switches, push button switches, rotor switches, tack keys, dip switches, slide switches, key lock switches, push wheel switches, knob switches, snap action switches or the like, with or without display indicators such as lights, alarms, key pads, or other position indicators. Various control devices are available from APEM, Colehersee and E-switch Lamb Industries. The control device is also operatively connected to a plug that provides power to the heating device 10. Wiring 42 is also connected between the control device 41 and the heating elements 44 of the heating system 40 of the present invention.

Figure 4:
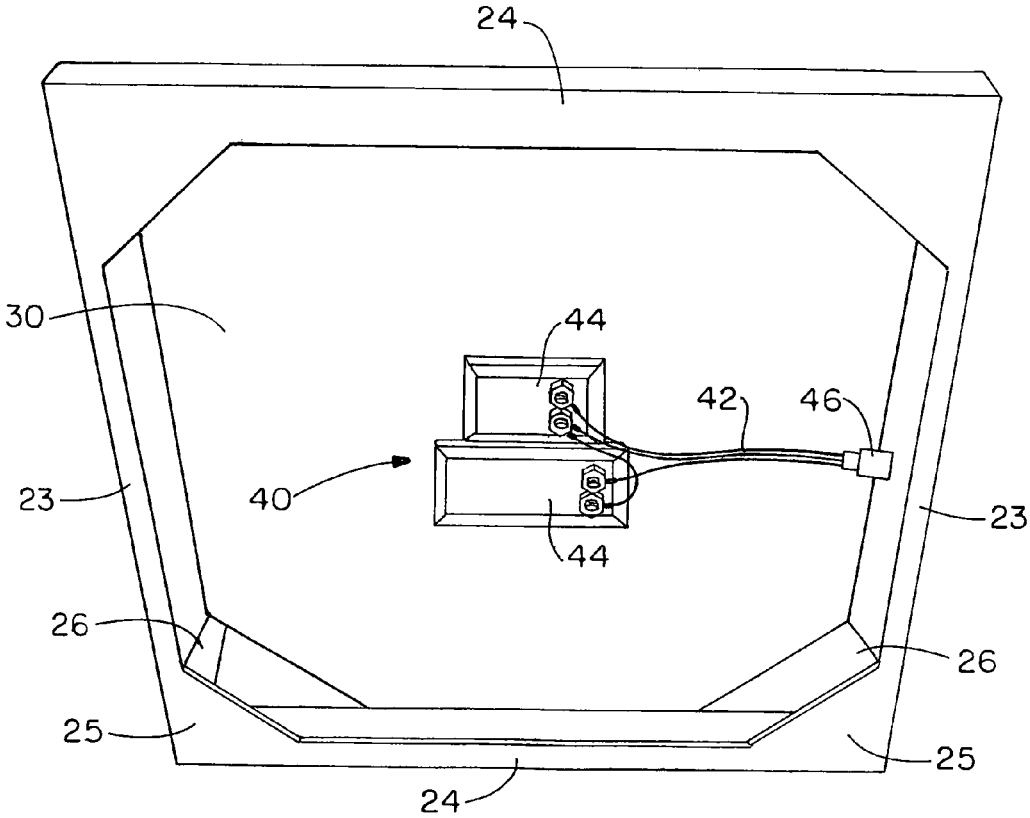
FIG. 4 is a bottom perspective view of one embodiment of the heating device particularly illustrating two different heating elements operatively connected to the base.

An important part of the invention is the configuration of the heating system 40. The heating system 40 includes one or more, and preferably two or more heating elements 44. The heating elements are preferably operatively attached to a portion of base 30, such as shown in FIG. 4.

The heating element is operatively connected to the base utilizing generally any suitable means, such as an adhesive, fastener, or the like. For ease of replacement, heating elements are preferably connected utilizing fasteners to base 30. In one preferred embodiment, the heating element is an electric strip heating element. Electric strip heating elements are available from just a few watts to over 2,000 watts, and can be individually configured to a desired shape. Electric heat strip elements are available from sources such as Wattco, Selfa, Hot Set, Hotwatt and Tutco. In some embodiments the strip heating element includes a body provided with contacts, with a body comprising a desirable heat transfer medium, for example aluminum.

Other types of heating elements can be utilized, for example ceramic, hot air, coil, molybdenum, plug heaters, rack assembly, rod element, radiant tube, ribbon tungsten, flexible, surface, cartridge, foil, tubular, finned cast and mica heating elements.

Heating elements 44 are selected to provide the base 30 with a predetermined temperature or temperature range whereby the base functions as a warming device that will slowly raise the temperature of the material, for use the same day, i.e. generally within the number of hours, or a longer period of time, such as through overnight heating so that the material may be properly processed the next day. Variations of the heating elements can be utilized in order to meet higher or lower processing temperatures required by a multitude of products or to allow for more rapid temperature rise parameters as required by the end user. Accordingly, the heating device of the present invention is quite versatile.

The heating elements are designed to utilize standard 120 or 240 volt AC current. The wattages of the heating elements 44 are generally low and therefore require a relatively small amount of power to operate efficiently. Multiple heating elements can be plugged into a single source of power, such as 120 volt and 20 amp service without causing an overload and tripping a circuit breaker. For example, FIG. 4 illustrates two heating elements, with the first heating element comprising a 120 watt heating element and the second heating element comprising a 180 watt heating element fastened to the base 30 of heating device 10. An important feature of the present invention is that the heating elements and thus the heating system do not require a thermostat or rheostat to operate and are thus free thereof.

In a further embodiment of the present invention, the heating device 10 is provided with two or more interchangeable bases 30 that each can be exchanged on the frame 20 in order to heat different materials. In one embodiment a first base is labeled with a desired temperature range and provided with one or more, and preferably two or more heating elements that provide the indicated heating range, i.e. a first heating range. The heating system frame is further provided with a wiring system having a plug 46 that operatively is connected to the frame 20, see FIG. 4 and has one end connected to cabling attached to control device 41 and a second end or connector mateable with a plug or connector 42 operatively connected to heating elements 44, such as shown in FIG. 4. A second base is provided with a plurality of different heating elements and a second connector mateable with plug 46 of the wiring system and provides for a second temperature range of heating, i.e. second heating range, different than the first heating range. In this manner, a plurality of different bases 30 can be interchanged on frame 20 to provide for a desired heating effect. The heating range of each of the bases can be marked on the bases in one embodiment as a clear indicator to the user of the specifications of a particular base so that the user can choose the correct base to heat a particular composition.

Base 30 of the heating device 10 comprises a heat conducting material. In one embodiment, the base 30 comprises or preferably consists essentially of a metal, for example aluminum. The material of the base must be able to conduct a desired amount of heat through the base and into the container generally disposed thereon such as set forth in FIG. 1. Moreover, the base must be stable at the desired temperature range. Thus, the base and thus the heating device and system are free of a glass impregnated silicone heater mat and a silicone insulated edge foil heater. In a further embodiment the base is provided with a raised edge 32 extending at least an inch above the planar upper surface 31 of base 30. Preferably edge 32 is archial in shape and conforms to the outer diameter of a drum such as illustrated in FIG. 1.

Figure 5:
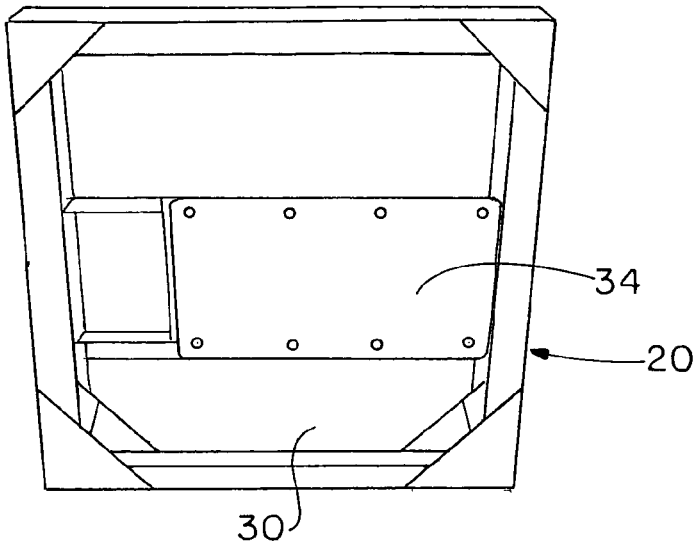
FIG. 5 is a bottom perspective view of one embodiment of the heating device of the present invention including an insulating cover with heating elements located between the insulating cover and the heat conducting base of the device.

Preferably, the base is provided with a heating element cover 34 connected to the bottom surface of base 30, such as illustrated in FIG. 5. The cover 34 is preferably an insulated cover such that the heat from each heating element is directed into the highly heat conductive base 30 causing the same to radiate heat relatively evenly. The cover has an aperture in order to allow insulated electrical wiring to pass therethrough in order to be connected to the heating element. The cover 34 preferably has a layer of insulation inside of a shell and thereby substantially reduces or prevents heat from being transferred through the floor or other heat sink surface that the device 10 sits upon. The insulation also allows a very high amount of heat energy produced by the heating element to be focused into the heat conductive base and thus into the container. The area of the bottom surface of the base not covered by the cover 34 is optionally insulated with an insulating material such as rigid or flexible foam, or even fiberglass to further increase the efficiency and utility of the heating device. That said, the base insulation is also sometimes referred to a jacket, blanket, or the like is not meant to exclude other insulation materials that can be utilized to cover or shield the heating element, and thus conserve energy and further direct heat into base 30.

The shell of cover 34 is preferably formed from a metal, such as aluminum that serves to protect the insulation, wiring, and heating elements attached to the heat conductive base. The cover 34 can be connected to the base by a fastener such as a bolt, screw or the like. Desirably the cover plate 34 is removable such that future maintenance or access to the heating element can take place. The shell of the cover 34 also protects against abuse or accidental damage and keeps the operator away from hot surfaces that can potentially burn or from the electrical connections.

As indicated hereinabove, the heating device includes mounting brackets preferably in frame 26 that allow the frame to be fastened to or through a floor where other surface such as a vehicle. Moreover, the unit can be utilized outdoors at a job or site location where drums or containers are temporarily stored outside for processing. Base 30 and frame 20 can be manufactured at generally any size in order to accommodate any manufactured container.

An important benefit of the lower wattage heating system is the device will be able to slowly heat up the chemical to a processing temperature but not overheat the same allowing the materials to reach a peak temperature or balance but if using out excess heat through the metal or plastic skin of the container. Therefore, know the types of controls are required. Additionally, each type of chemical that requires heat and stability for processing can be supplied with the heating element and base system that is customized toward the required processing parameters.

As indicated herein the heating elements are preferably directly connected to the bottom of the base that the container sets upon. When the control device is activated, heat is generated and starts to buildup in a localized zone around the one or more heating elements present. The heat generated begins to move outward through the base by conduction along the base. Preferably the container is provided with an edge that contacts the base with the edge extending outwardly from the bottom of the container and thereby providing an air space in a central location of the container between the container and the base of the heating device. This air space aids in reduction of hot spot transfer of heat between the heated base and the container. The air space additionally allows for even flow of heat to develop under the container that is generated through the convection process. The heating device of the present invention utilizes both conduction and convection heat transfer. The size of the air space can range generally from about a half to about one inch in height between the base and the bottom of the drum.

Figure 6A:
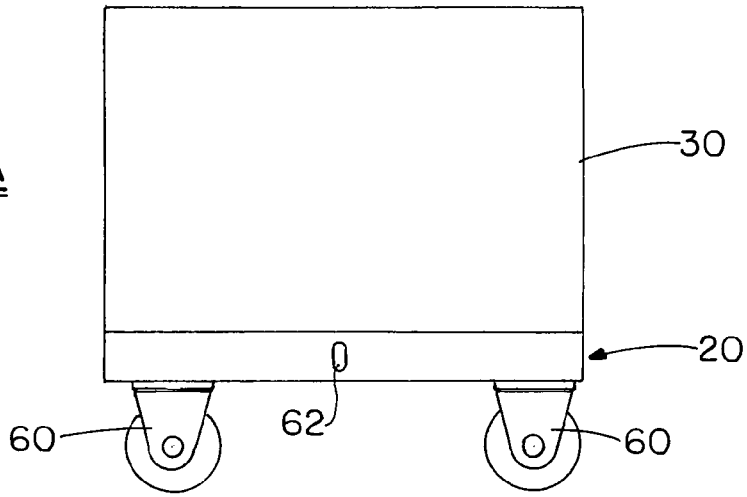
FIG. 6A is a side perspective view of one embodiment of the heating device of the present invention including a plurality of wheels and a key slot for a towing bar.

In a further embodiment of the present invention, the heating device 10 is provided with wheels such that movement of the device can be provided. For example as illustrated in FIG. 6A, a wheel assembly such as a wheel or caster, can be connected to a portion of the frame 20. In one embodiment, four wheel assemblies are provided and are generally connected to the outside corners of frame 20. The wheels can be provided in various sizes in order to accommodate movement of the heating device 10 in the container of materials such as a drum located or mounted thereon, generally on the upper surface of base 30. One or more of the wheel assemblies can include a locking system as known in the art in order to fix a wheel of the assembly in place and thus prevent movement of the heating device at a desired location.

Figure 6B:
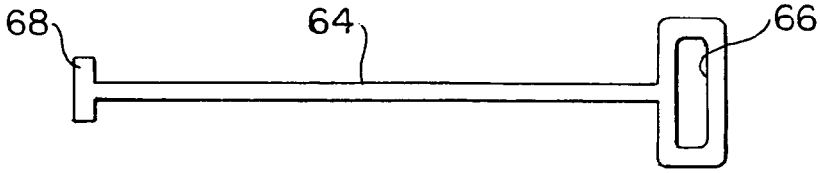
FIG. 6B illustrates a top perspective view of one embodiment of a tow member including a handle that can be utilized to transport the heating device of the present invention.

In a further embodiment the heating device 10 can be provided with a tow member 64 such as illustrated in FIG. 6B that includes a handle 66 and a fastening element 68. The tow member 64 can be connected to the heating device, such as at frame 20 through a suitable connection member, for example connection element 62 illustrated in FIG. 6A. In the embodiments illustrated in FIGS. 6A and 6B, the connection element is in particular a key slot and the fastening element 68 includes a key end mateable with a key slot that allows the heating device to be pulled or pushed to any desired location.

In a further embodiment, the pair of wheel assemblies can be located underneath the device 10 and operatively connected to frame 20 in the area adjacent pillar 26. In this manner, the device can be transported similar to a dolly wherein the pillar 26 is utilized as a handle.

Figure 7:
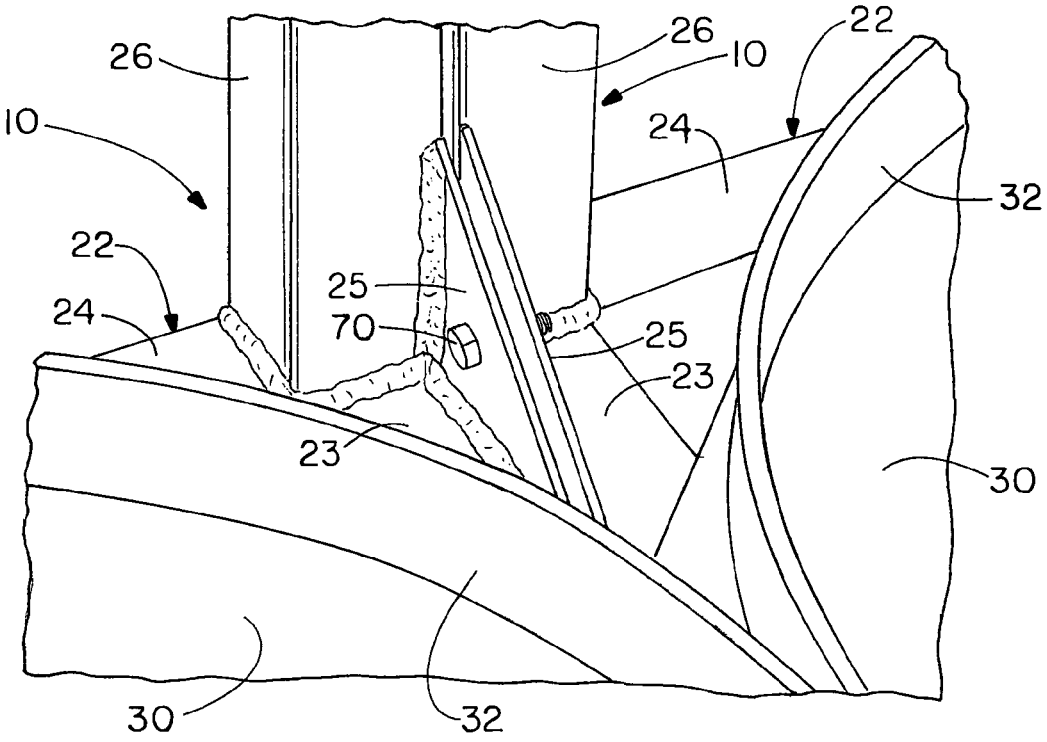
FIG. 7 is a perspective view partially illustrating two heating devices connected by a connecting member and thus in modular form.

As illustrated in FIG. 7 a pair of heating devices 10 are connected in modular form by a connecting member 70. It is to be understood that two or more heating devices can be connected in tandem. The connecting member can be any suitable fastener that is connected through generally any portion of one frame 20 of a drum heating device 10 to another frame 20 of a second drum heating device 10. The embodiment illustrated in FIG. 7, the connecting member is a nut and bolt that is connected through adjacent support members connecting pillar 26 and lower member 22 of frame 20. Thus multiple heating devices can be connected in a compact and space saving manner.

In accordance with the patent statutes, the best mode and preferred embodiment have been set forth, the scope of the invention is not limited thereto, but rather by the scope of the attached claims.

What is claimed is:

1. A heating device for a container, comprising:

a frame comprising a pair of lower members connected to a pair of crossmembers, a base connected to the frame; and a conduction heating system comprising a heating element connected to a bottom surface of the base, the base comprising a heat conducting material, when the heating element is adapted to transfer heat generated into the base, wherein the heating system is free of a rheostat and a thermostat, wherein the base has an upper surface including a heat conducting raised edge adapted to be positioned adjacent a bottom edge of a container, and the upper surface is adapted to directly contact the container and conduct heat thereto.

2. The heating device according to claim 1, wherein two or more heating elements are present and the heating device has a plurality of heating positions.

3. The heating device according to claim 2, wherein the base includes an insulating cover with the heating elements located between the base and cover, the cover including an insulating jacket that directs heat into the base.

4. The heating device according to claim 3, wherein the frame includes a key slot and a tow member mateable in the key slot for moving the device from a first location to a second location.

5. The heating device according to claim 2, wherein the heating elements are connected to a first connector that is mateable with a plug of a wiring system of the frame that has an end operatively connected to a control device.

6. The heating device according to claim 4, wherein the frame is provided with a plurality of wheels.

7. A heating device for a container, comprising:

a frame with a wiring system having a plug connected to the frame and also operatively connected to a control device;

a first base having one or more heating elements and a first heating range; the one or more heating elements connected to a first connector; and a second base having one or more heating elements and a second heating range different than the first heating range, the one or more heating elements connected to a second connector, wherein the first base and the second base are separate and individually interchangeable on the frame and the first connector and the second connector are mateable with the plug of the wiring system, wherein the first base and second base each have an upper surface that is adapted to directly contact the container and conduct heat thereto.

8. The heating device according to claim 7, wherein the first base and second base each have two or more heating elements.

9. The heating device according to claim 8, wherein the bases have an upper surface including a heat conducting raised edge adapted to be positioned adjacent a bottom edge of a container.

10. The heating device according to claim 9, wherein the bases include an insulating cover with the heating elements located between the base and cover, the cover including an insulating jacket that directs heat into the base.

11. The heating device according to claim 7, wherein the frame is provided with a plurality of wheels.

12. The heating device according to claim 11, wherein the frame includes a key slot and a tow member mateable in the key slot for moving the device from a first location to a second location.

13. The heating device according to clam 7, wherein the frame comprises a pair of lower members connected to a pair of crossmembers, wherein the one or more heating elements are connected to a bottom surface of the respective bases, and wherein the heating device is free of rheostat and a thrmostat.

14. A heating device for a container, comprising:

a frame comprising a pair of lower members connected to a pair of crossmembers, a base connected to the frame; and a heating system comprising a heating element connected to a bottom surface of the base, the base comprising a heat conducting material and an upper surface adapted to directly contact the container and conduct heat thereto, wherein the base consists essentially of a metal, when the heating element is adapted to transfer heat generated into the base, wherein the heating system is free of a rheostat and a thermostat.

15. The heating device according to claim 14, wherein two or more heating elements are present and the heating device has a plurality of heating positions.

16. The heating device according to claim 15, wherein the base upper surface includes a heat conducting raised edge adapted to be positioned adjacent a bottom edge of a container.

17. The heating device according to claim 15, wherein the base includes an insulating cover with the heating elements located between the base and cover, the cover including an insulating jacket that directs heat into the base.

18. The heating device according to claim 15, wherein the heating elements are connected to a first connector that is mateable with a plug of a wiring system of the frame that has an end operatively connected to a control device.

* * * * *